US011857854B2

(12) United States Patent
Angelelli

(10) Patent No.: US 11,857,854 B2
(45) Date of Patent: Jan. 2, 2024

(54) HANDLE EXTENSION

(71) Applicant: Paolo Angelelli, Bergen (NO)

(72) Inventor: Paolo Angelelli, Bergen (NO)

( * ) Notice: Subject to any disclaimer, the term of this patent is extended or adjusted under 35 U.S.C. 154(b) by 51 days.

(21) Appl. No.: 18/157,391

(22) Filed: Jan. 20, 2023

(65) Prior Publication Data

US 2023/0181981 A1 Jun. 15, 2023

Related U.S. Application Data

(63) Continuation-in-part of application No. 17/546,182, filed on Dec. 9, 2021, now abandoned.

(51) Int. Cl.
*A63B 60/16* (2015.01)
*A63B 60/14* (2015.01)

(52) U.S. Cl.
CPC ..... *A63B 60/16* (2015.10); *A63B 60/14* (2015.10)

(58) Field of Classification Search
CPC ..... A63B 60/16; A63B 60/12; A63B 60/14; A63B 2102/02; A63B 2102/04; A63B 2102/065; A63B 2102/08; A63B 2102/16
See application file for complete search history.

(56) References Cited

U.S. PATENT DOCUMENTS

| | | | | |
|---|---|---|---|---|
| 2,046,191 A | | 6/1936 | Smith | |
| 3,203,697 A | | 8/1965 | Berzatzy | |
| 3,712,618 A | | 1/1973 | Berzatzy | |
| 4,641,838 A | | 2/1987 | Gabrielidis | |
| 4,850,079 A | | 7/1989 | Thompson | |
| 6,059,675 A | | 5/2000 | Finn | |
| 6,152,831 A | * | 11/2000 | Arcenas | A63B 53/14 473/409 |
| 6,261,188 B1 | * | 7/2001 | Badura | F41B 15/027 473/568 |
| 7,201,683 B2 | | 4/2007 | Estape et al. | |
| 11,065,518 B2 | | 7/2021 | Sharum | |
| 2009/0042660 A1 | | 2/2009 | Shaw | |
| 2012/0214624 A1 | | 8/2012 | Stein | |
| 2016/0271459 A1 | | 9/2016 | Rocchi et al. | |
| 2018/0043225 A1 | * | 2/2018 | Lau | A63B 49/035 |
| 2019/0290984 A1 | | 9/2019 | Sharum | |

FOREIGN PATENT DOCUMENTS

| | | |
|---|---|---|
| CN | 2306807 | 2/1999 |
| WO | 2004090462 A1 | 10/2004 |

* cited by examiner

*Primary Examiner* — Jeffrey S Vanderveen
(74) *Attorney, Agent, or Firm* — MP Patents, LLC

(57) ABSTRACT

An endcap for a sporting implement includes a base portion and a transverse extension projecting from the base portion. The base portion has a bottom surface with a central axis normal thereto. A receptacle opposite the bottom surface is configured to receive a portion of the sporting implement. The extension is configured such that, during swinging of the sporting implement with a hand of a user gripping around the sporting implement portion, the extension contacts an exterior lateral portion and upper portion of fifth proximal phalanx of a user's hand and the hand is constrained in both the transverse and longitudinal aspects while being allowed rotation of a first metacarpal of the hand away from the central axis.

20 Claims, 13 Drawing Sheets

HANDLE EXTENSION

SUMMARY

The disclosure describes an endcap for a sporting implement. The endcap includes a rigid base portion and a transverse extension projecting from the base portion. The rigid base portion includes a bottom surface having a central axis normal thereto, opposite the bottom surface, a receptacle configured to receive a portion of the sporting implement and, surrounding the receptacle, at least one sidewall flaring towards the bottom surface. The rigid transverse extension has a width at a longitudinal cross-section maximum height that is no greater than 75% of a width of the base portion.

The disclosure also describes another endcap for a sporting implement. The endcap includes a rigid base portion and a rigid transverse extension projecting from the rigid base portion. The rigid base portion includes a bottom surface having a central axis normal thereto, opposite the bottom surface, a receptacle configured to receive a portion of the sporting implement and, surrounding the receptacle, at least one sidewall flaring towards the bottom surface. The rigid transverse extension includes, directed away from the rigid base portion bottom surface, a continuous upper surface which sweeps through an arc of less than 90 degrees away from the rigid base portion bottom surface.

Further, the disclosure describes a pallet system for a sporting implement. The pallet system includes a prism and a transverse extension. The prism includes first and second mating shells configured to house and grip a handle core of the sporting implement. The prism also includes a first end configured to receive an endcap and having a center, a second end distal from the first end having a center, a central axis defined between the center of the first end and the center of the second end and an exterior surface defined between first and second ends, surrounding the central axis and flaring towards the first end. The transverse extension projects from the exterior surface near the first end and has a width at a longitudinal cross-section maximum height that is no greater than 75% of a width of the prism.

Still further, the disclosure describes a pallet system for a sporting implement. The pallet system includes a prism and a transverse extension. The prism includes first and second mating shells configured to house and grip a handle core of the sporting implement. The prism also includes a first end configured to receive an endcap and having a center, a second end distal from the first end and having a center, a central axis defined between the center of the first end and the center of the second end and an exterior surface defined between the first and second ends, surrounding the central axis and flaring towards the first end. The transverse extension projects from the exterior surface near the first end, and includes, directed towards the second end, a continuous upper surface which sweeps through an arc of less than 90 degrees towards the second end.

BRIEF DESCRIPTION OF THE FIGURES

The summary above, as well as the following detailed description of illustrative embodiments, is better understood when read in conjunction with the appended drawings. For the purpose of illustrating the disclosure, example constructions are shown in the drawings. However, the disclosure is not limited to specific methods and instrumentalities disclosed herein. Moreover, those having ordinary skill in the art will understand that the drawings are not to scale. Wherever possible, like elements have been indicated by identical numbers.

Embodiments of the disclosure will now be described, by way of example only, with reference to the following diagrams wherein.

DETAILED DESCRIPTION

The following detailed description illustrates embodiments of the disclosure and manners by which they can be implemented. Although the preferred mode of carrying out disclosed systems, endcaps, pallets and methods has been described, those of ordinary skill in the art would recognize that other embodiments for carrying out or practicing disclosed systems, endcaps, pallets and methods are also possible.

It should be noted that the terms "first", "second", and the like, herein do not denote any order, quantity, or importance, but rather are used to distinguish one element from another. Further, the terms "a" and "an" herein do not denote a limitation of quantity, but rather denote the presence of at least one of the referenced item.

Modern swingable sports equipment or implements, such as rackets for tennis, racquetball, squash, badminton, pickleball and padel as well as table tennis paddles typically include a head or blade portion coupled to a bar handle portion. Performing the swing with a conventional bar handle requires a user grip the handle with a considerable amount of gripping force to prevent the racket from sliding or twisting.

Known attempts to improve swing performance while allowing a user a more relaxed grip on the handle aim to support a user's fifth metacarpal with a broad extension. Other known attempts aim to lock the user's hand to the handle with an extension which curves through an arc of greater than 90 degrees.

Embodiments of the disclosure provide an improvement for sporting equipment handles. Embodiments of the disclosure substantially eliminate, or at least partially address, problems in the prior art, preventing sliding or twisting of a user's hand on a racket handle by supporting a user's fifth proximal phalanx with a relatively narrow extension. Embodiments of the disclosure may also provide a pivot point for swinging of the sporting equipment vertically.

Embodiments of the disclosure can be applied to many swingable items, including but not limited to rackets for tennis, racquetball, squash, badminton, pickleball and padel as well as table tennis paddles.

Additional aspects, advantages, features and objects of the disclosure will be made apparent from the drawings and the detailed description of the illustrative embodiments construed in conjunction with the appended claims that follow. It will be appreciated that described features are susceptible to being combined in various combinations without departing from the scope of the disclosure as defined by the appended claims.

Handle assemblies of modern rackets typically includes an inner shaft or core, a pallet and a grip. In some cases, such as tennis, rackets include a throat portion coupling the handle portion to the blade portion. The pallet is an outer region which is typically positioned or applied over the shaft. This type of handle assembly may be terminated by a cap or endcap also commonly referred to as a buttcap.

Figure 11:
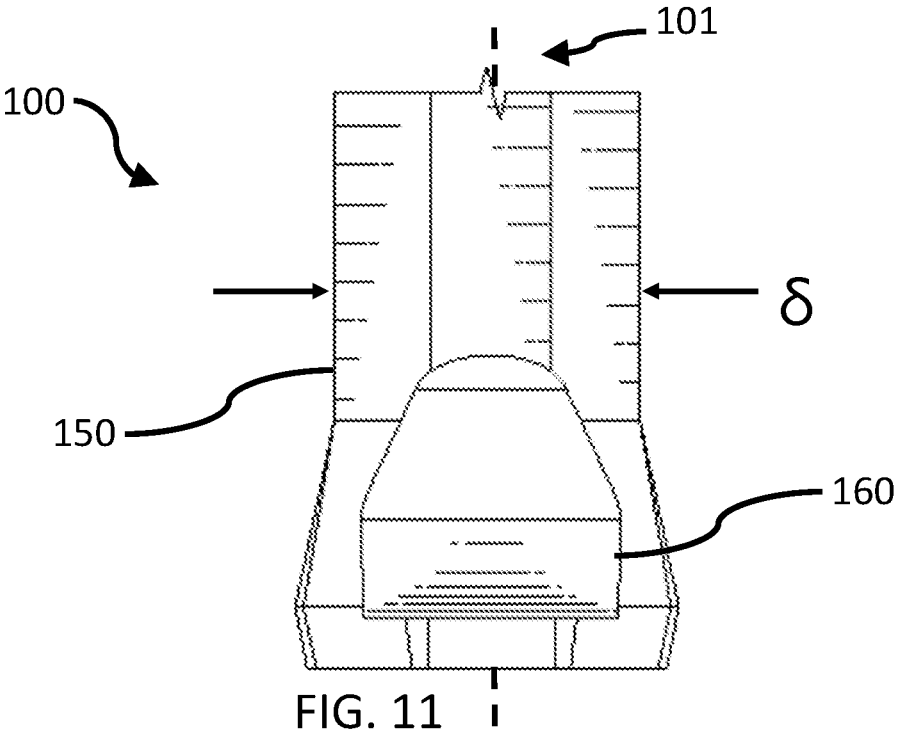
FIG. 11 illustrates an example width measurement of the example endcap of FIGS. 1-5.
Figure 12:
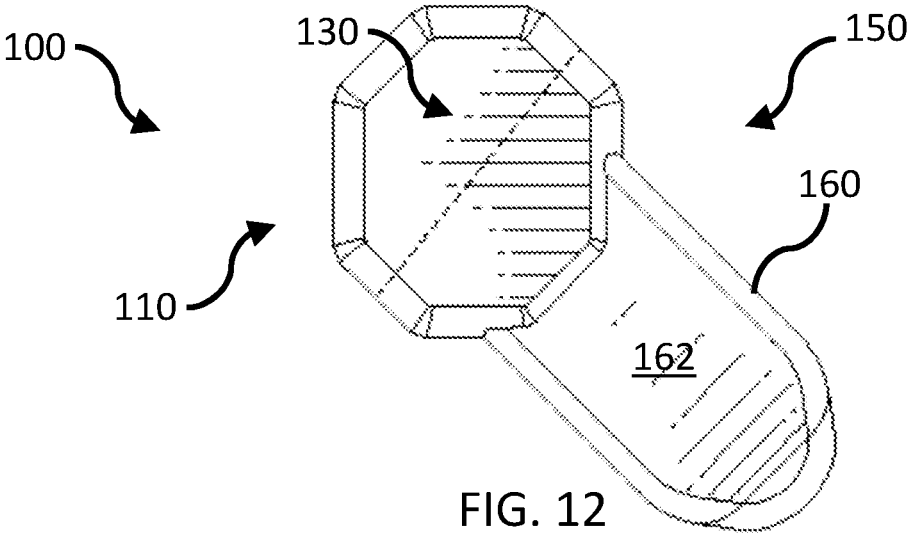
FIG. 12 illustrates a top view of the example endcap of FIGS. 1-5.

FIGS. 1-5 & 11-13 illustrate an example endcap 100 for a sporting implement. Endcap 100 includes a base portion (110 and 150) and a transverse extension 160 projecting from the base portion. Extension 160 includes a tip distal from the base which may be rounded. The base portion has a bottom surface 130 with a longitudinal or central axis 101 normal thereto (FIG. 12). A receptacle 170 or hollow interior opposite bottom surface 130 is configured to receive a portion of the sporting implement such as handle pallets. Receptacle 170 may be configured with the same internal shape as an exterior surface of the portion of the sporting implement to which it will be applied, may it be a handle pallet or a handle shaft.

Figure 1:
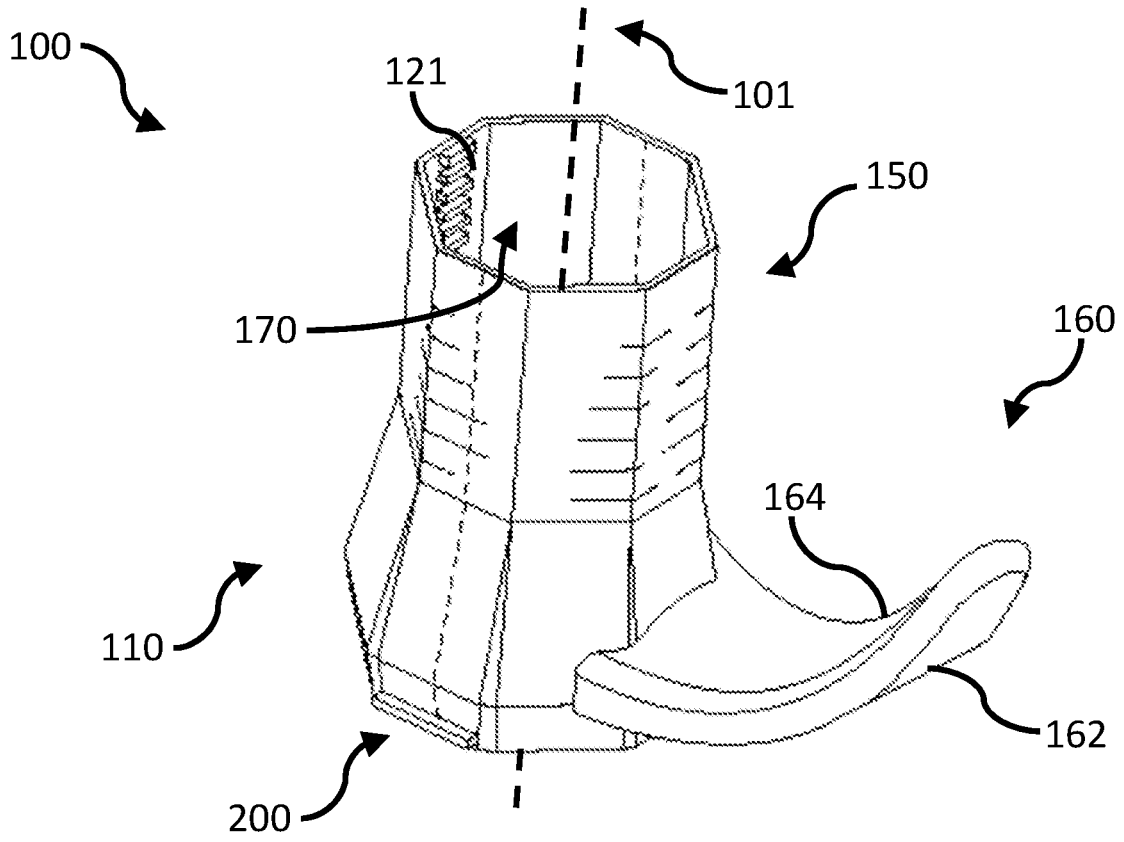
FIG. 1 illustrates an isometric view of an example endcap.
Figure 2:
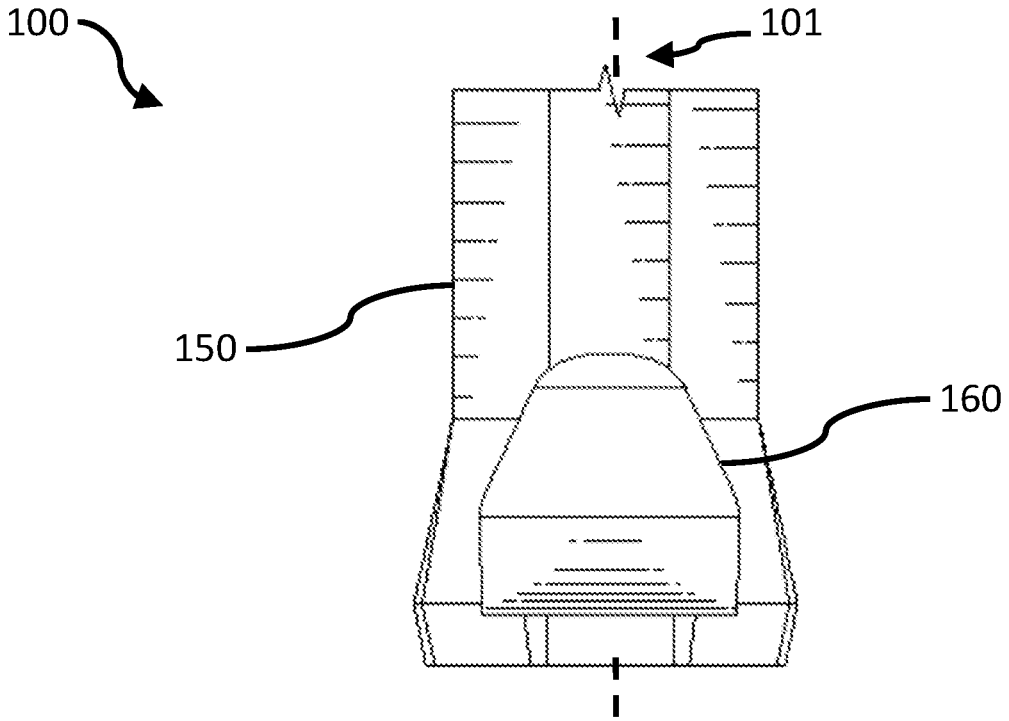
FIG. 2 illustrates a right-side view of the example endcap of FIG. 1.
Figure 3:
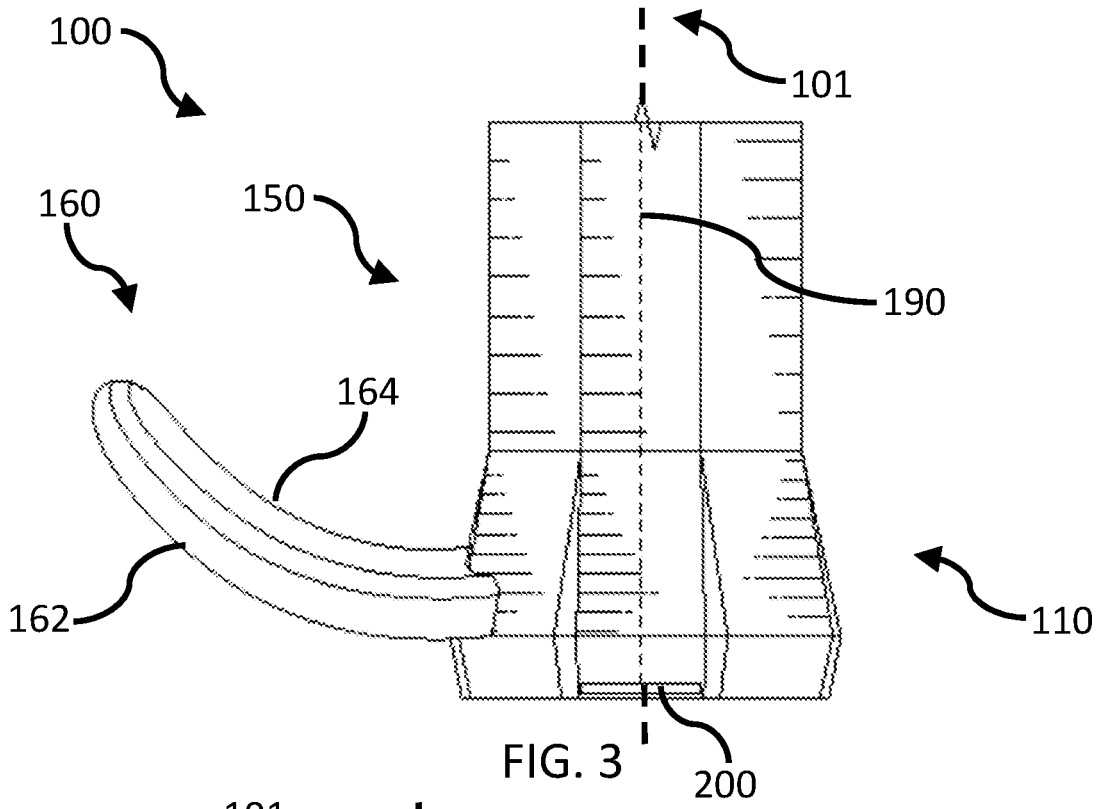
FIG. 3 illustrates a rear view of the example endcap of FIGS. 1 & 2.
Figure 4:
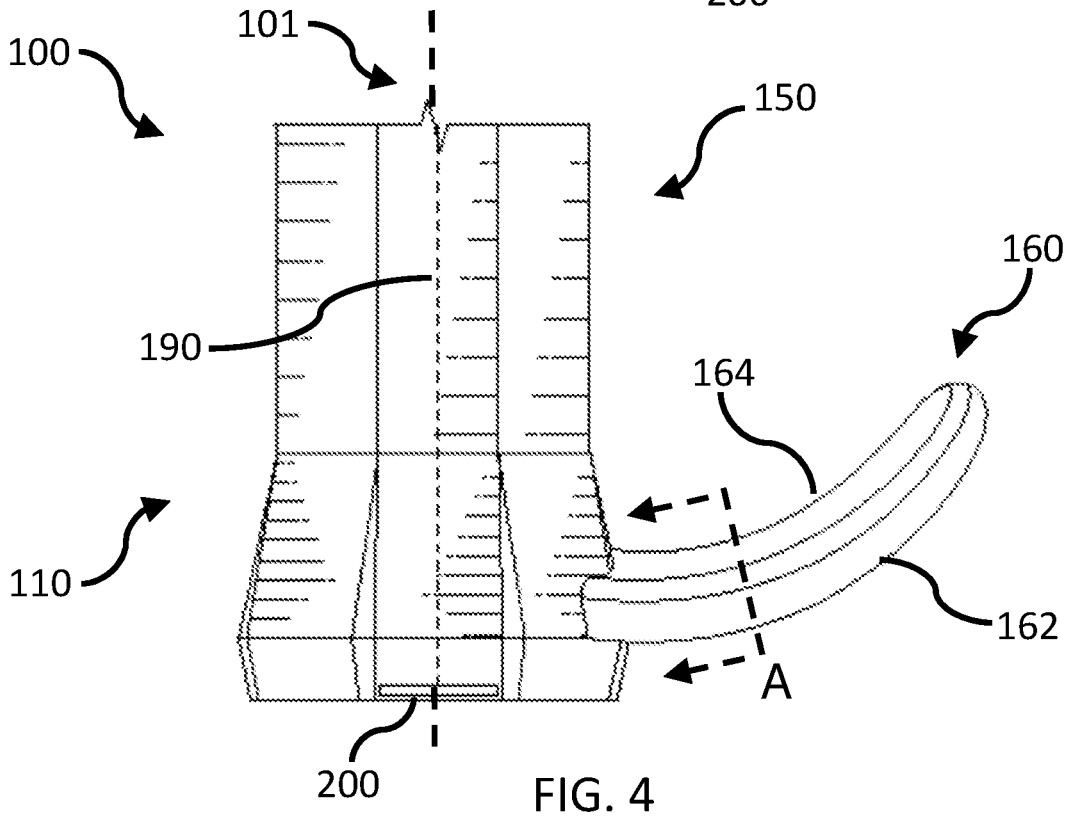
FIG. 4 illustrates a front view of the example endcap of FIGS. 1-3.

In an example, extension 160 includes an inside surface 164 facing generally towards central axis 101 and an outside surface 162 opposite the inside surface. Inside surface 164 faces towards central axis 101 in contrast with facing in the same direction as central axis 101 or away from central axis 101 and may also be considered to face away from bottom surface 130. Outside surface 162 faces generally away from central axis 101 in contrast with facing towards central axis 101 or in the same direction as central axis 101 and may also be considered to face generally in the same direction as bottom surface 130. Inside surface 164 may be generally smooth without corners or discontinuities that might cause discomfort to the hand of a user. Further, inside surface 164 may be concave while outside surface 164 is convex (FIGS. 3 & 4). A grip such as a tape may be wrapped around extension 160 to adjust surface texture.

Figure 5:
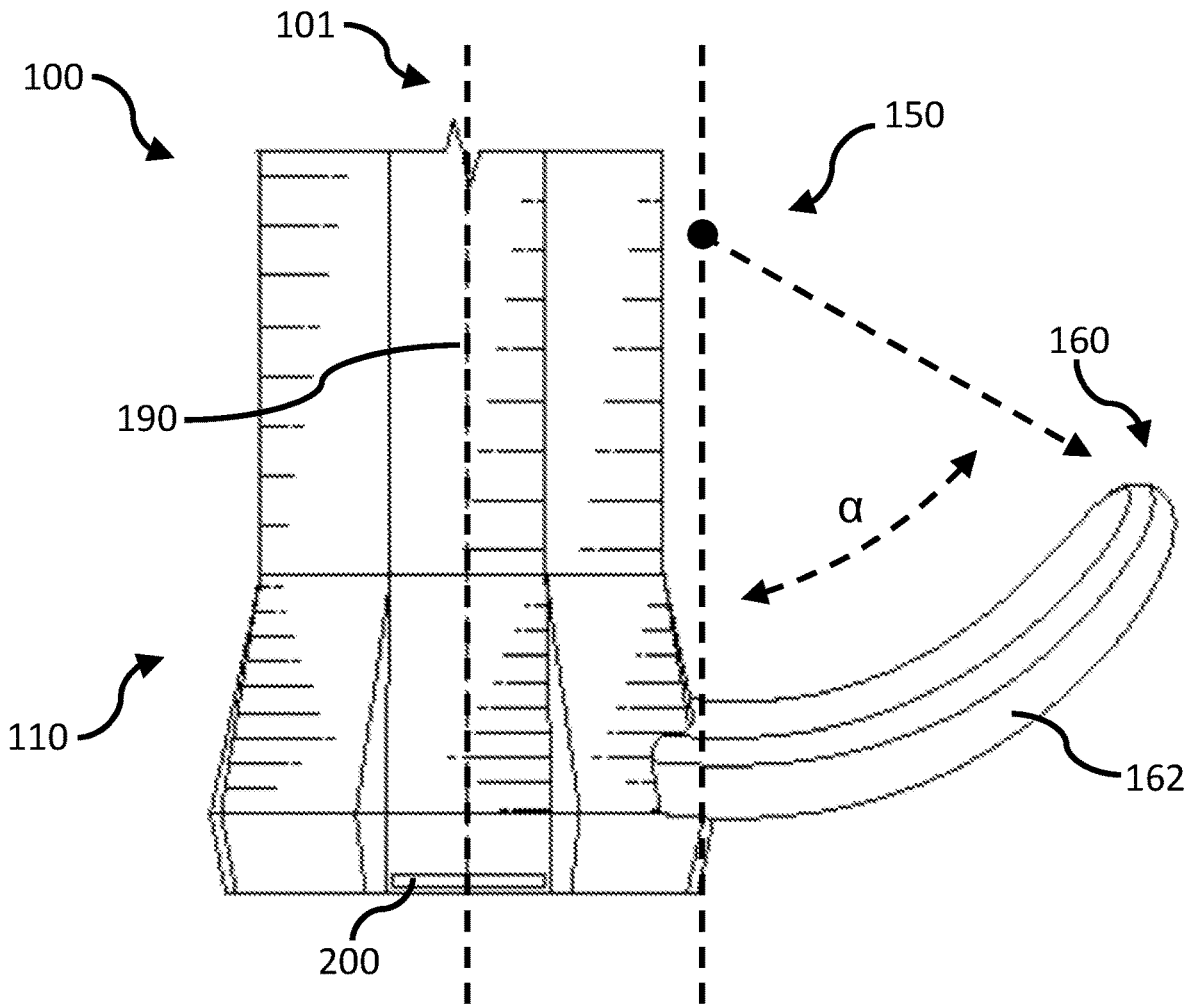
FIG. 5 illustrates an example extension curvature suitable for use in association with the example endcap of FIGS. 1-4.
Figure 6:
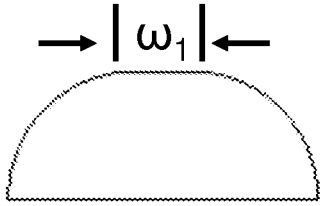
FIGS. 6-10 illustrate example extension cross-sections suitable for use in association with the example endcap of FIGS. 1-5.
Figure 7:
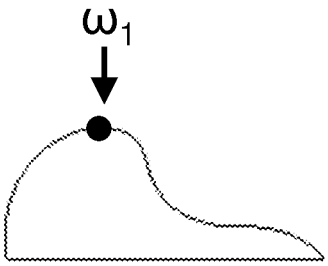
Figure 8:
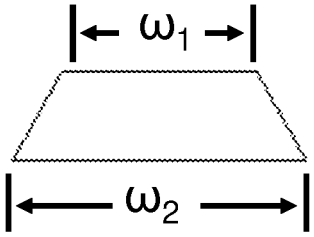
Figure 9:
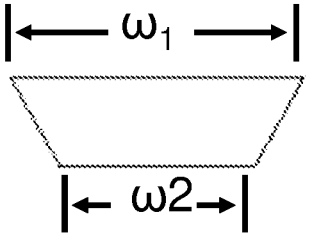
Figure 10:
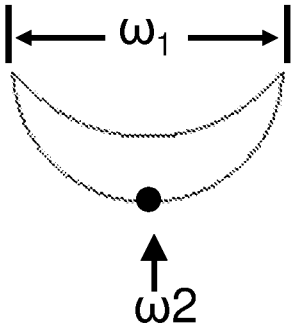

In an example, the center of curvature of extension 160 is directly above the connection point of extension 160 to base portion of endcap 100. Similarly, a tangent line to extension outside surface 162 and perpendicular or transverse to central axis 101, intersects outside surface 162 at the connection point of extension 160 to base portion of endcap 100 (FIGS. 3-5).

Figure 27:
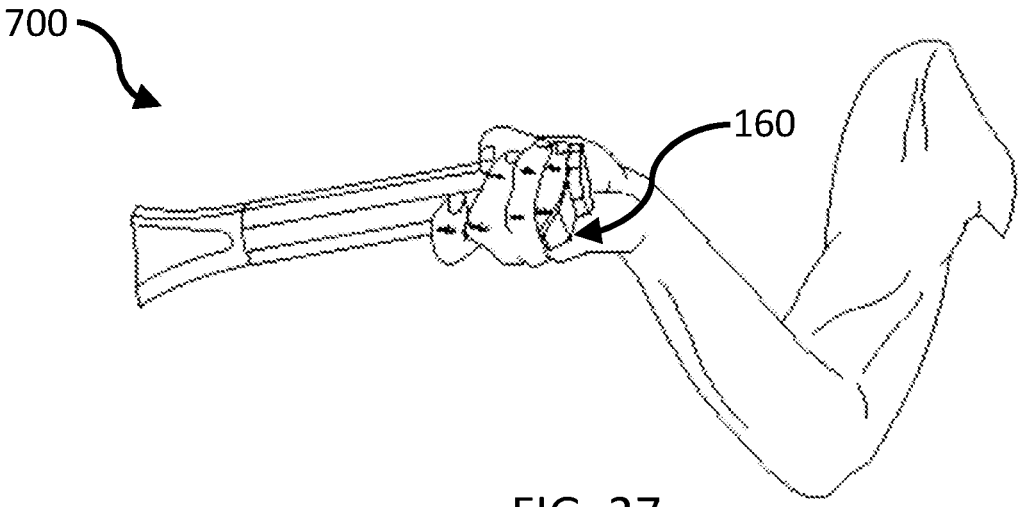
FIG. 27 illustrates example sporting equipment used in association with an example handle extension in accordance with embodiments of the disclosure.

Extension 160 is configured such that, during swinging of the sporting implement with a hand of a user gripping around the base portion (110 and 150), the extension contacts an exterior lateral portion and upper portion of fifth, fourth or third proximal phalanxes of the user's hand (FIG. 27). The hand is constrained in both the transverse and longitudinal aspects while being allowed rotation of a first metacarpal of the hand away from central axis 101.

In an example, extension 160 curves towards central axis 101. Referring to FIG. 5, a continuous inside surface 164 sweeps through an arc away from the rigid base portion bottom surface 130. Critically, this arc is subtended by angle $\alpha$ which measures less than 90 degrees. With this arrangement, extension 160 does not obstruct change of grip on the sporting implement and/or endcap 100, does not prevent swinging of the sporting implement and does not prevent wrist flicking of the sporting implement, particularly, when the sporting implement is a racket. In an example, extension 160 sweeps through an arc such that a measures of 60 degrees.

Endcap 100 may take any of a variety of forms suitable for use in association with a sporting implement. In an example, endcap 100 may be shaped with eight bevels (flats) or elongate, generally planar regions. Eight elongate ridges are formed between the bevels along the length. In an example, endcap 100 exhibits an octagonal cross-section with a flare at the base. In a further example wherein endcap 100 is used in association with a racket, extension 160 is centered on the second, fourth, sixth or eighth bevel with the racket webbing and/or blade aligned with the first and fifth bevels.

FIGS. 6-10 represent a variety of alternative cross-sections section plane A of FIG. 4 may yield. The cross-sectional view of FIG. 6 reflects a non-zero width $\omega_1$ at the longitudinal cross-section maximum height. The cross-sectional view of FIG. 7 reflects a width $\omega_1$ of zero at the longitudinal cross-section maximum height. The cross-sectional view of FIG. 8 reflects a non-zero width $\omega_1$ at the longitudinal cross-section maximum height which is less than the width $\omega_2$ at the longitudinal cross-sectional minimum height. While not a preferred form, the cross-sectional view of FIG. 9 reflects a non-zero width $\omega_1$ at the longitudinal cross-section maximum height which is greater than the width $\omega_2$ at the longitudinal cross-sectional minimum height. While also not a preferred form, the cross-sectional view of FIG. 10 reflects a non-zero width $\omega_1$ at the longitudinal cross-section maximum height and a width $\omega_2$ of zero at the longitudinal cross-section minimum height.

With reference to FIG. 11, rigid transverse extension 160 has a critical width at a longitudinal cross-section maximum height that is no greater than 75% of a width $\delta$ of the base portion. At these relative dimensions, the width of surface 164 of the transverse extension which contacts the user's fifth finger does not exceed the length of the fifth proximal phalanx. As such, pressure on the joints of the finger is avoided to improve comfort and reduce risk of injury. Further, this width will not impede swift change of orientation of the grip on the endcap.

In another example wherein endcap 100 is used in association with a racket, extension 160 is rotated from a plane of a racket blade by between 50 and 90 degrees around central axis 101. In a further example, extension 160 is rotated from the plane of the racket blade by about 70 degrees. In another example, the degree of rotation from the plane of the racket blade may be varied by degree of rotation of endcap 100 relative to a handle core.

Endcap 100 may be formed from any of a variety of rigid, lightweight materials including but not limited to polyurethane and other polymers, nylon and composite materials such as graphite sheets or grafil.

Figure 13:
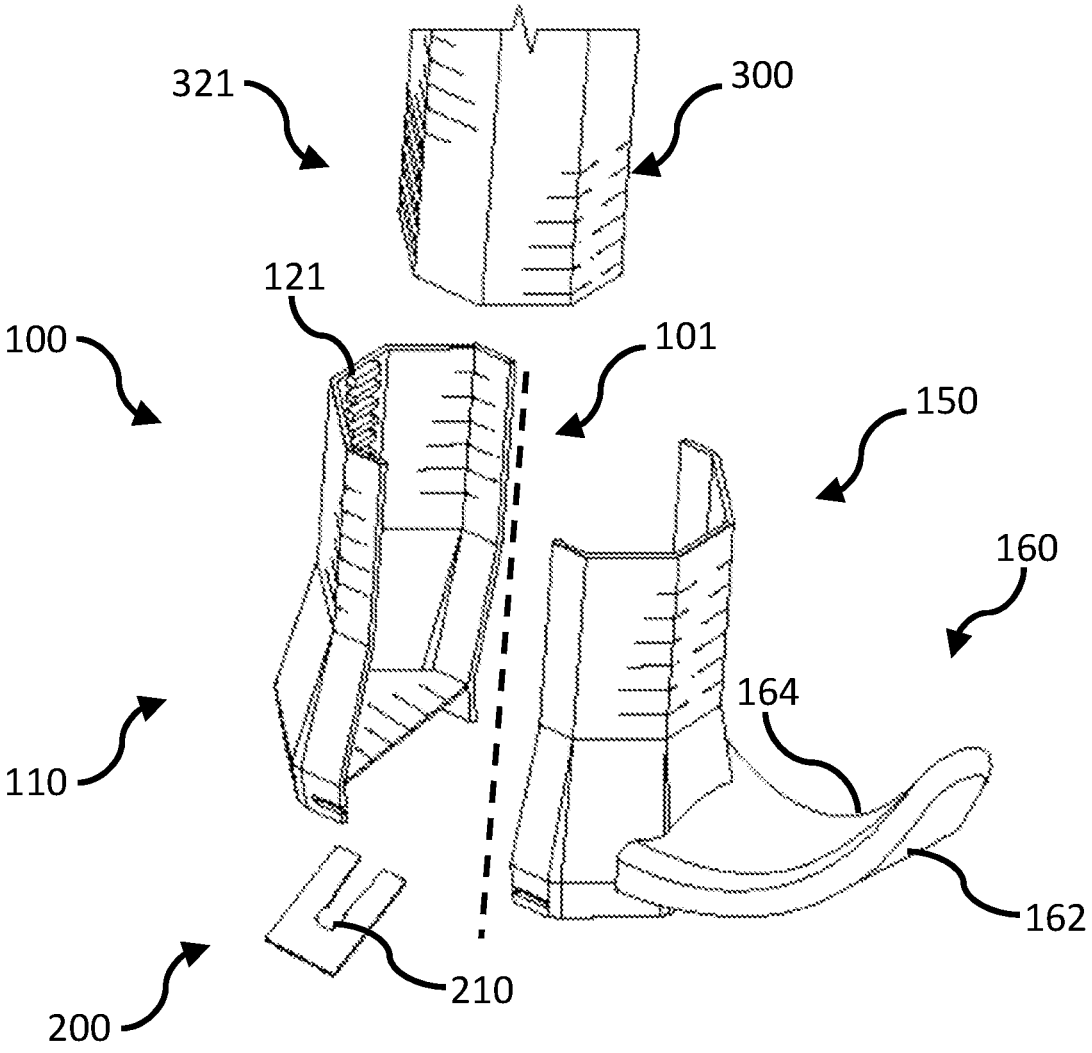
FIG. 13 illustrates an exploded view of the example endcap of FIGS. 1-5 as it may be coupled with an example handle pallet.
Figure 14:
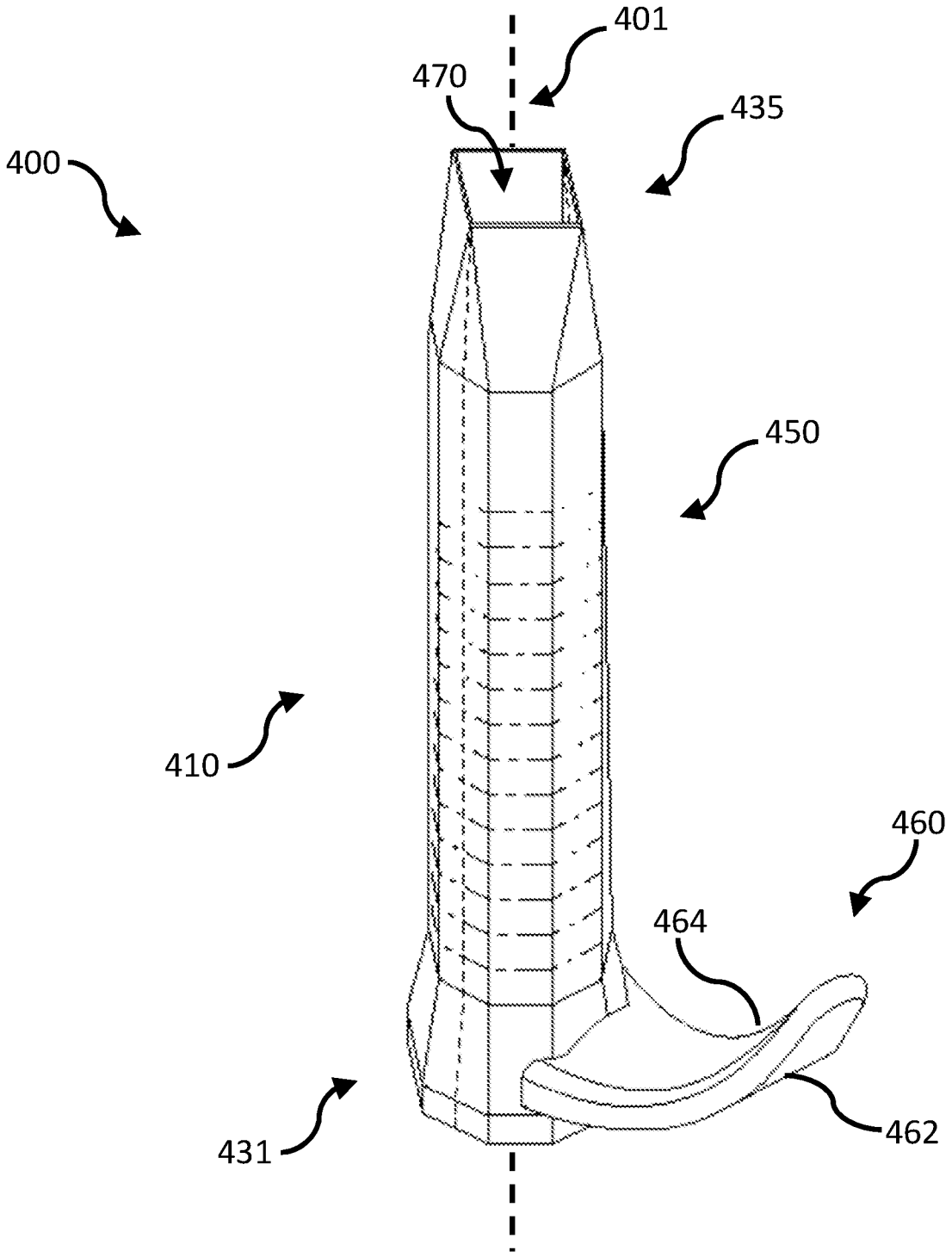
FIG. 14 illustrates an isometric view of an example pallet system.
Figure 15:
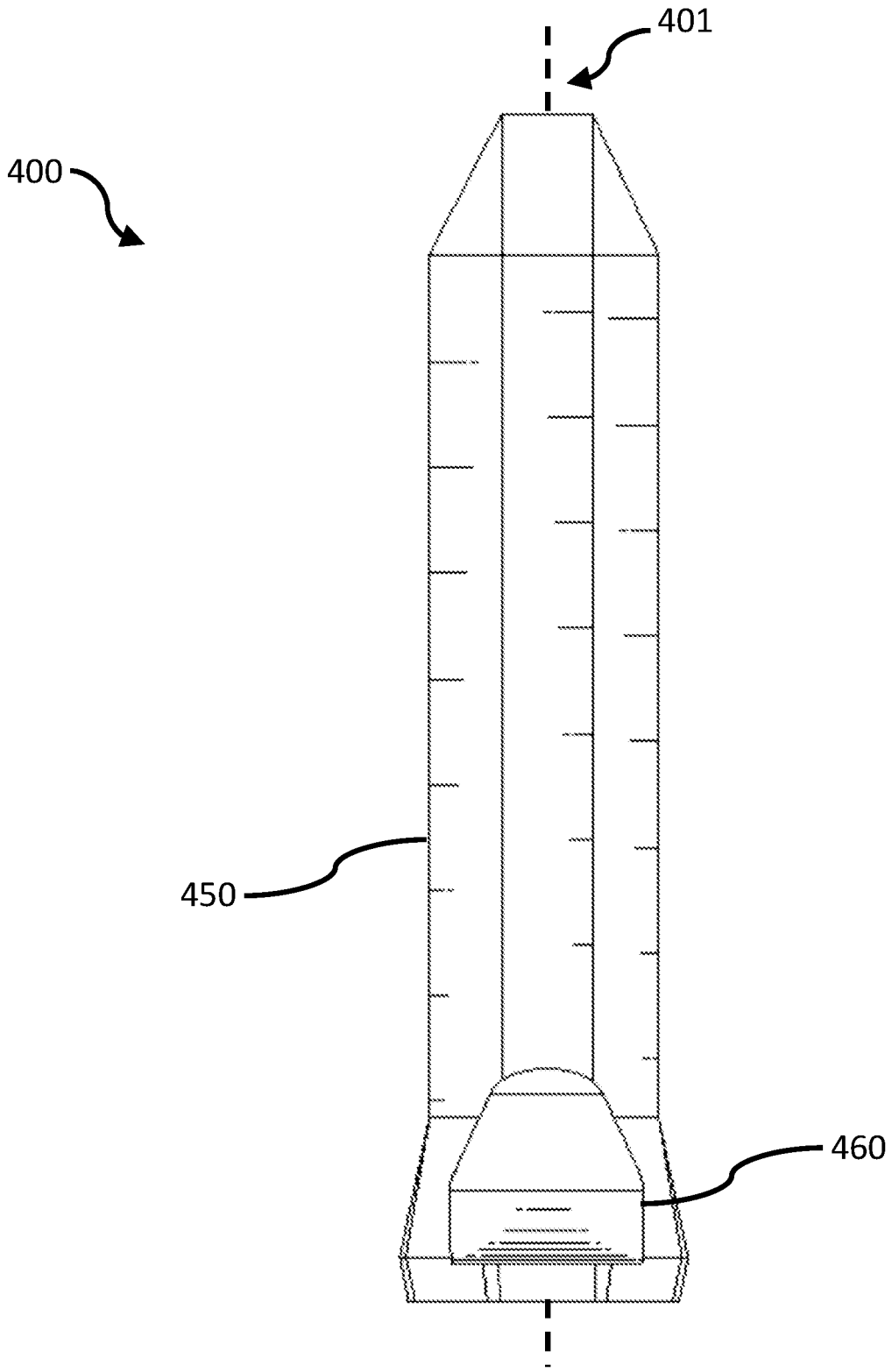
FIG. 15 illustrates a right-side view of the example pallet system of FIG. 14.

At least one tab 121 (FIG. 1) may be provided to receptacle 170 and configured to engage one of a series of notches provided to an exterior surface of a handle pallet. The base portion may include first 110 and second 150 mating shells. FIG. 13 illustrates an exploded view of the example endcap of FIGS. 1-4 as it may be coupled with an example pallet or pallet assembly 300. A clip 200 may be provided to first and second mating shells 110 and 150 to secure the same together on handle pallet 300 with ridges 121 engaged with slots 321. With shells 110 and 150 aligned and placed against the pallet so as to mate with slots 321 through ridges 121, clip 200 may be inserted through a slot in the bottom of the base portion until constraining opening 210 is clicked into place around mated half posts (not visible) of the respective shells 110 and 150.

Endcap 100 may be coupled or attached to a pallet or pallets in any of a variety of alternatives to tabs of receptacle 170 engaging with slots on a pallet or pallets. In another example, endcap 100 and a pallet or pallets may be provided with notches or holes for engaging with separate removable tabs or pegs. In another example, the base portion may further include, extending from a rim of receptacle 170, one or more resilient arm members or tabs with abutment surfaces configured to engage one or more slot perforations of the handle pallet. In this example, the resilient arms clip the endcap to the handle pallet. In another example, the cooperative parts are reversed such that slots are provided on/in the endcap and arms/tabs are provided to the handle pallet. In another example, the endcap may be coupled to the handle pallet by a bolt inserted through one or more holes through the base portion transverse to the central axis 101.

While FIGS. 1-5 & 11-13 reflect a plane of split 190 of endcap halves 110 and 150 on the fourth and eighth bevels and being spaced from extension 160 by one bevel, endcap halves 110 and 150 may be split along any bevels with the split being spaced from extension 160 by more or fewer bevels. In a further example, split plane 190 may be between two edges of endcap 100. In another example, endcap 100 may be divided into more than two pieces.

FIGS. 14-17 illustrate an example pallet system 400 configured for positioning over a shaft of a sporting implement. Pallet system 400 includes a prism configured to house and grip a handle core, hairpin or shaft of the sporting implement and a transverse extension 460. The prism has a first end 431 with a center, a distal second end 435 with a center and a central axis 401 defined between the center of the first end and the center of the second end. An exterior surface defined between first and second ends surrounds central axis 401. First end 431 is configured to receive an endcap.

Extension 460 is coupled to the prism at a base and includes a tip distal from the base. The tip may be rounded. Extension 460 projects from the exterior surface near first end 431 and is configured such that during swinging of the sporting implement with a hand of a user gripping around the prism, the extension contacts the hand on an exterior lateral portion and upper portion of a fifth, fourth or third proximal phalanx of the hand. The hand is constrained in both transverse and longitudinal aspects while being allowed rotation of a first metacarpal thereof away from central axis 401.

In an example, extension 460 may further include an inside surface 464 facing generally towards second end 435 and/or central axis 401. An outside surface 462 opposite inside surface 464 faces generally away from second end 435 and/or central axis 401. Inside surface 464 may be generally smooth without corners or discontinuities that might cause discomfort to the hand of a user. In another example, extension 460 may have a concave surface 464 facing towards the central axis 401.

Figure 16:
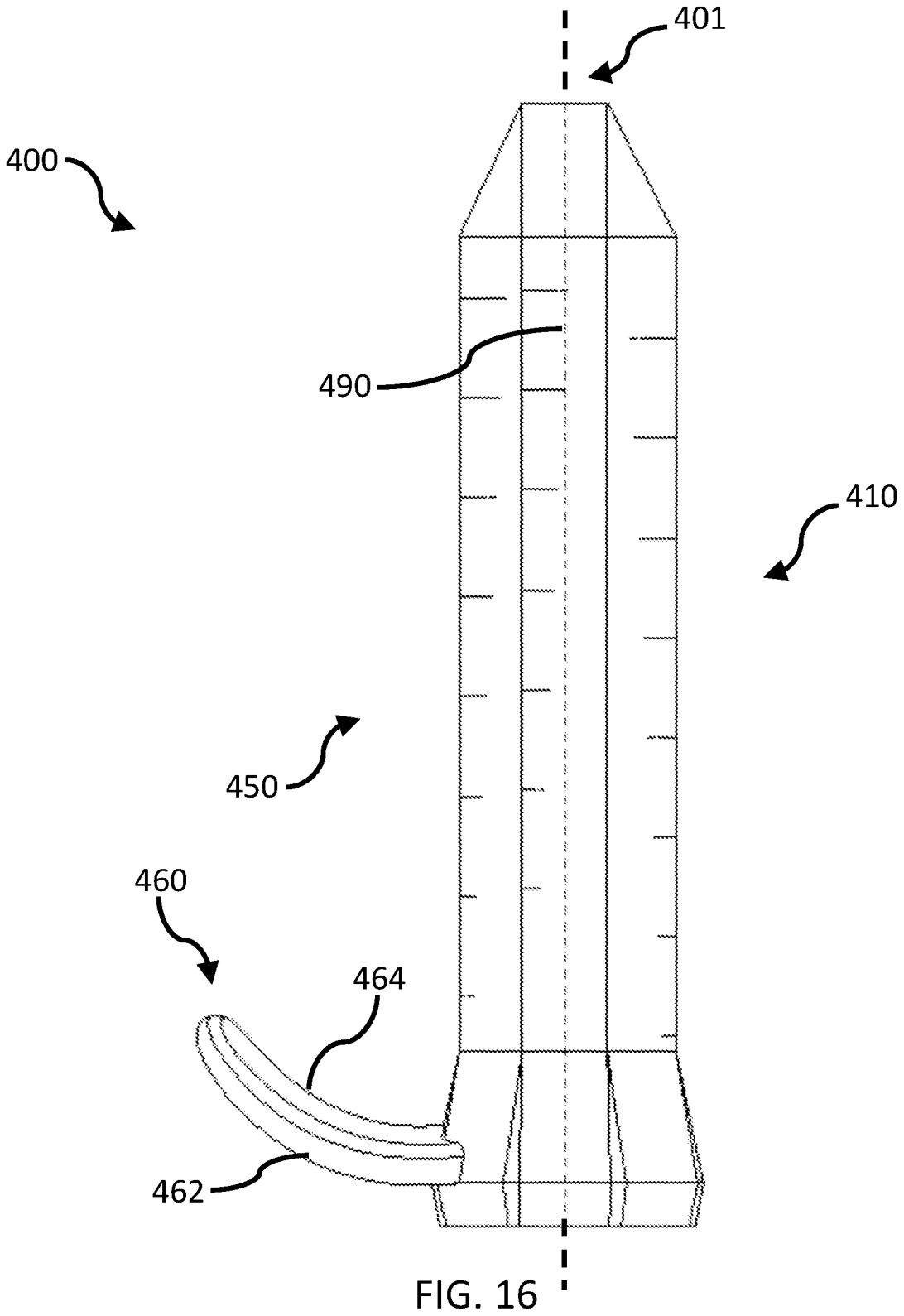
FIG. 16 illustrates a rear view of the example pallet system of FIGS. 14 & 15.

In an example, the center of curvature of extension 460 is directly above the connection point of extension 460 to one of the two half shells 410 and 450. Similarly, a tangent line to extension outside surface 462 and perpendicular or transverse to central axis 401, intersects outside surface 462 at the connection point of extension 460 to half shell 410 or half shell 450 (FIGS. 16 & 17).

In an example, extension 460 curves towards the central axis 401. In another example, extension 460 curves from first end 431 towards second end 435.

Figure 18:
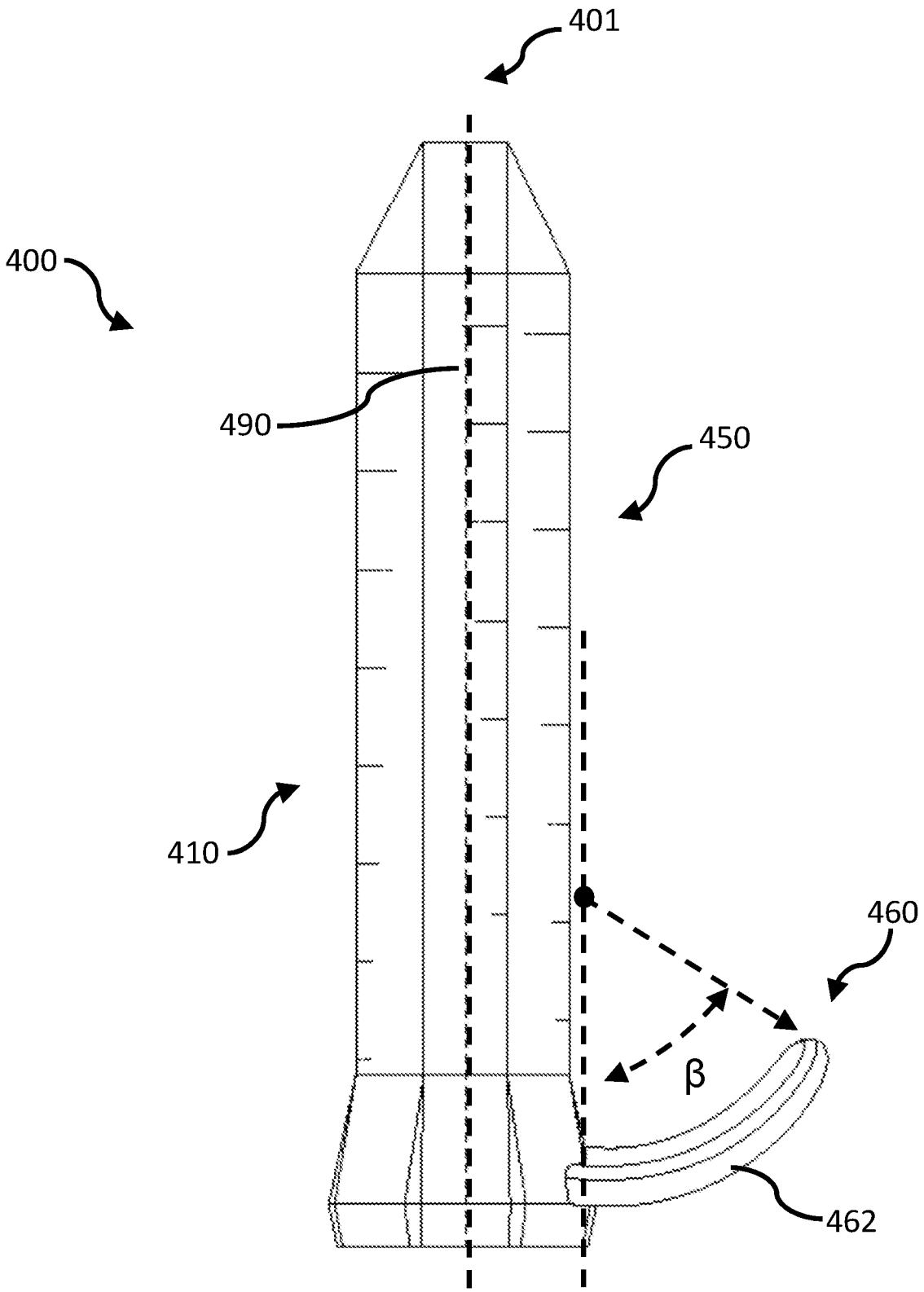
FIG. 18 illustrates an example extension curvature suitable for use in association with the example pallet system of FIGS. 14-17.
Figure 19:
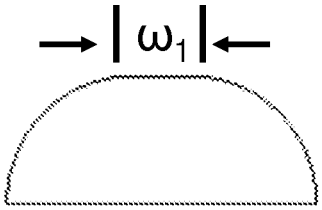
FIGS. 19-23 illustrate example extension cross-sections suitable for use in association with the example pallet system of FIGS. 14-18.
Figure 20:
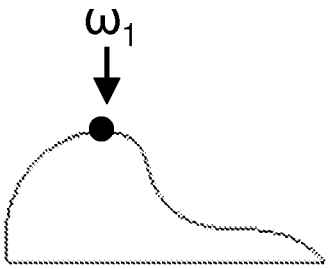
Figure 21:
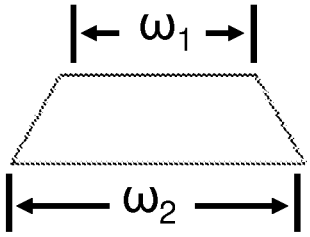
Figure 22:
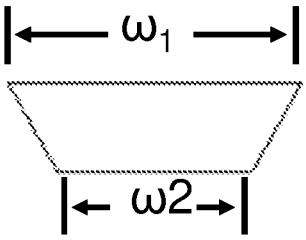
Figure 23:
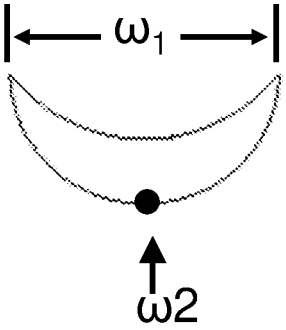

Referring to FIG. 18, a continuous inside surface 464 of extension 460 sweeps through an arc towards second end 435. Critically, this arc is subtended by angle $\beta$ which measures less than 90 degrees. With this arrangement, extension 460 does not obstruct change of grip on the sporting implement and/or pallets and/or pallet system and/or the prism. Further, extension 460 does not prevent swinging of the sporting implement and does not prevent wrist flicking of the sporting implement, particularly, when the sporting implement is a racket. In an example, extension 460 sweeps through an arc such that $\beta$ measures less than 60 degrees.

Figure 17:
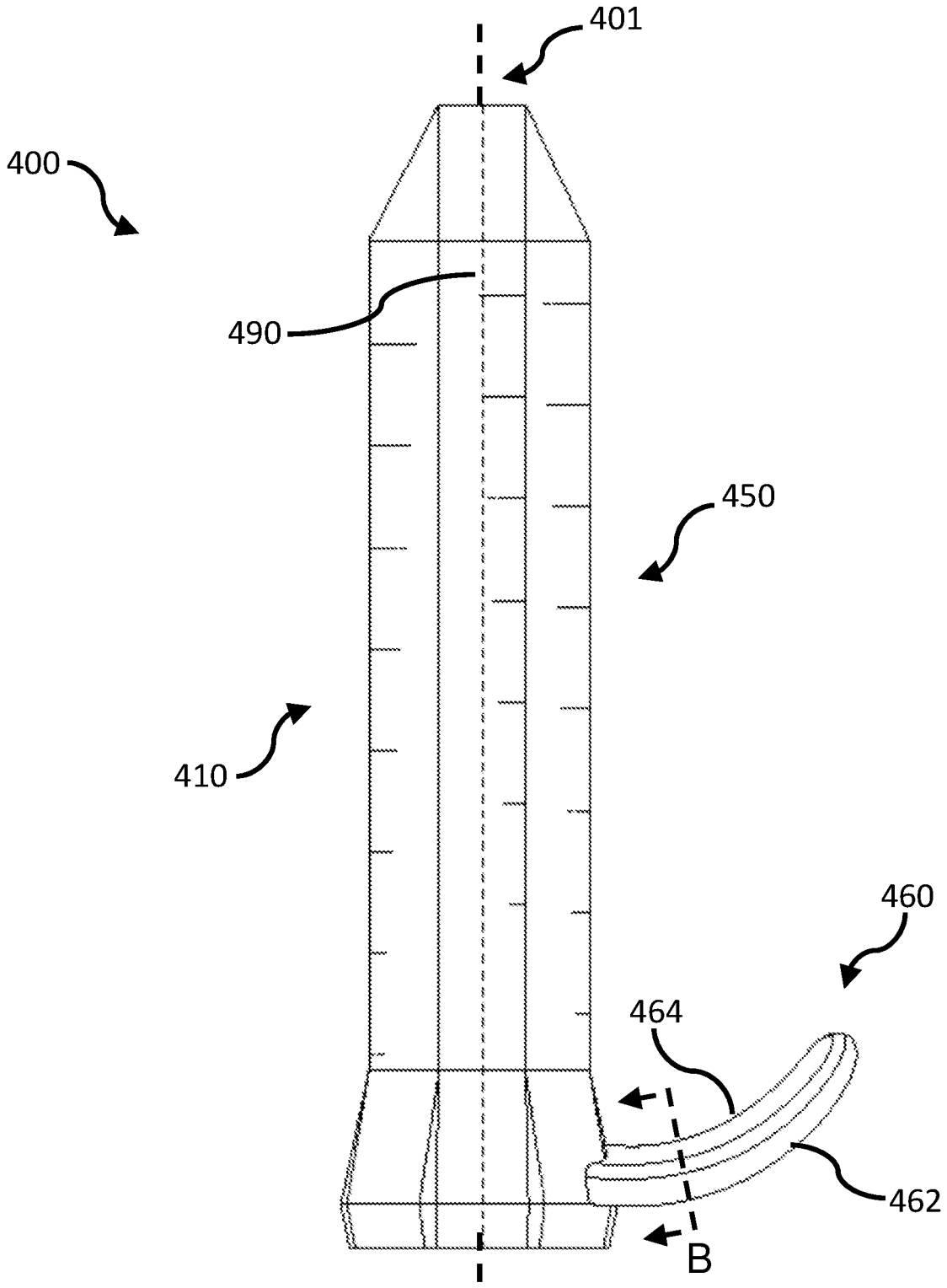
FIG. 17 illustrates a front view of the example pallet system of FIGS. 14-16.

FIGS. 19-23 represent a variety of alternative cross-sections plane B of FIG. 17 may yield. Similar to the above-mentioned cross-sections discussed with reference to FIGS. 6-10, the cross-sectional view of FIG. 19 reflects a first non-zero width $\omega_1$ at the longitudinal cross-section maximum height, the cross-sectional view of FIG. 20 reflects a width $\omega_1$ of zero at the longitudinal cross-section maximum height and the cross-sectional view of FIG. 21 reflects a non-zero width $\omega_1$ at the longitudinal cross-section maximum height which is less than the width $\omega_2$ at the longitudinal cross-sectional minimum height. While not a preferred form, the cross-sectional view of FIG. 22 reflects a non-zero width $\omega_1$ at the longitudinal cross-section maximum height which is greater than the width $\omega_2$ at the longitudinal cross-sectional minimum height. While also not a preferred form, the cross-sectional view of FIG. 23 reflects a non-zero width $\omega_1$ at the longitudinal cross-section maximum height and a width $\omega_2$ of zero at the longitudinal cross-section minimum height.

Figure 24:
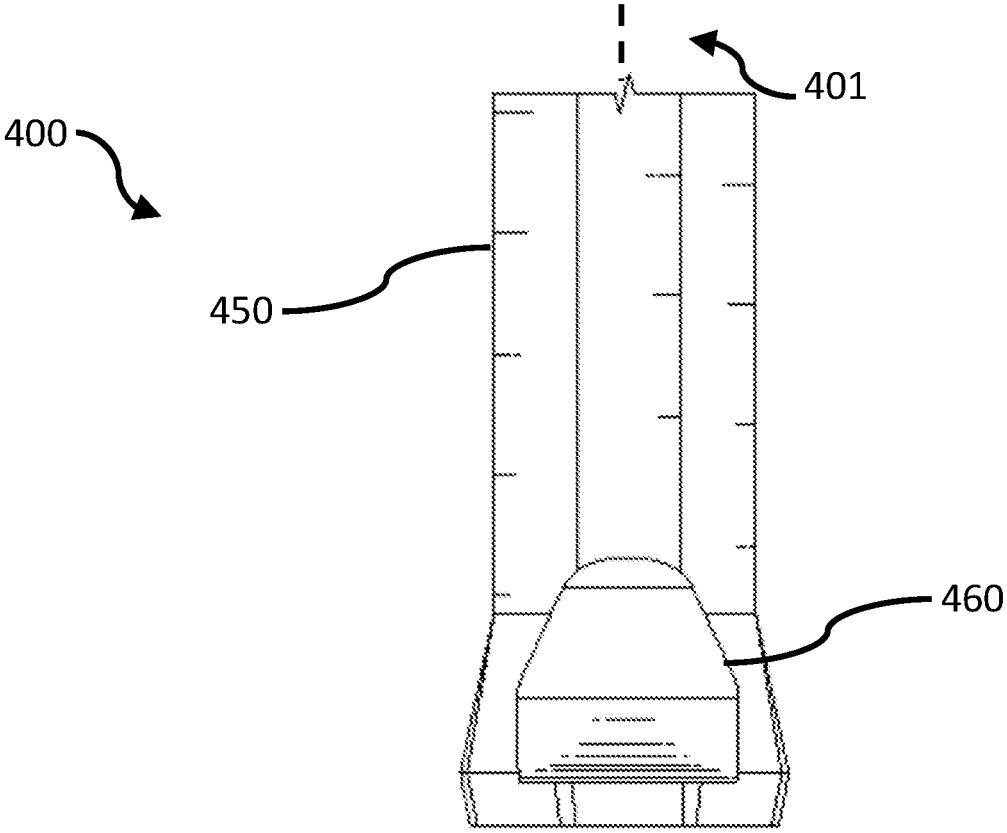
FIG. 24 illustrates an example width measurement of the example pallet system of FIGS. 14-18.

With reference to FIG. 24, rigid transverse extension 460 has a critical width at a longitudinal cross-section maximum height that is no greater than 75% of a width c of the prism. At these relative dimensions, the width of the surface of the transverse extension which contacts the user's fifth finger does not exceed the length of the fifth proximal phalanx. As such, pressure on the joints of the finger is avoided to improve comfort and reduce risk of injury. Further, this width will not impede swift change of orientation of the grip on the sporting implement and/or pallets and/or pallet system and/or the prism.

In an example wherein pallet system 400 is used in association with a racket, extension 460 is centered on the second, fourth, sixth or eighth bevel with the racket blade aligned with the first and fifth bevels. In another example wherein pallet system 400 is used in association with a racket, extension 460 is rotated from a plane of a racket blade by between 50 and 90 degrees around central axis 401. In a further example, extension 460 is rotated from the plane of the racket blade by about 70 degrees. In another example, the degree of rotation from the plane of the racket blade may be varied by degree of rotation of pallet system 400 relative to the handle core.

Pallet system 400 may be irremovably connected to the shaft during manufacturing, or the prism may be provided as two half shells 410 and 450 configured for coupling to the shaft either by adhesives or by other means.

Figure 25:
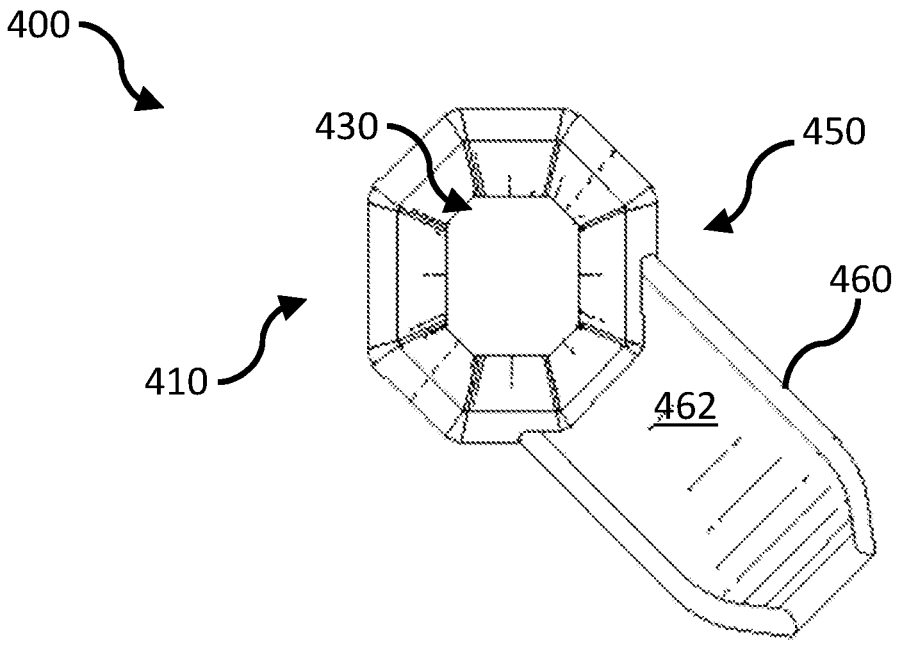
FIG. 25 illustrates a top view of the example pallet system of FIGS. 14-18.
Figure 26:
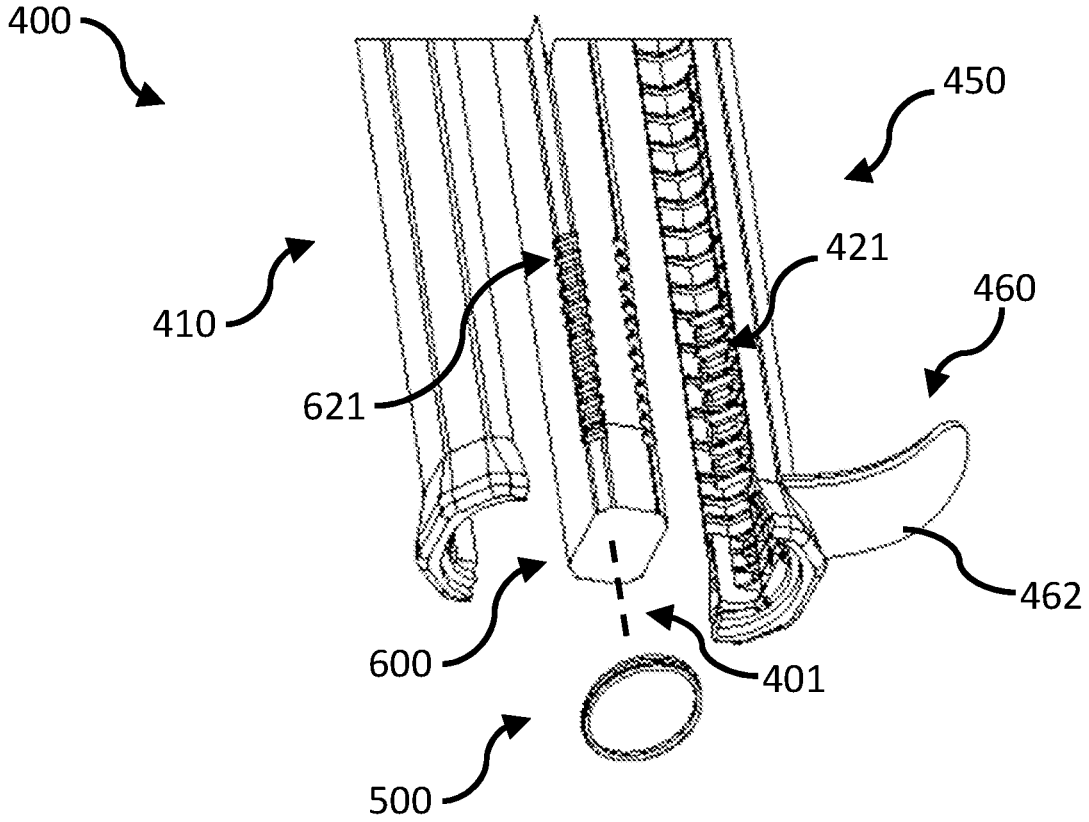
FIG. 26 illustrates an exploded view of the example pallet system of FIGS. 14-18 as it may be coupled with an example handle core.

FIG. 25 illustrates an exploded view of the example pallet system of FIGS. 14-18 as it may be coupled with an example handle core. First 410 and second 450 mating shells may include teeth 421 which engage with teeth 621 provided to an exterior surface of handle core 600 of the sporting implement. Wrapping a grip (not shown) around the first and second shells 410 and 450 may secure the same to the handle core of the sporting implement. The grip, may have various degrees of tackiness.

Pallet system 400 may be formed from any of a variety of rigid, lightweight materials including but not limited to polyurethane and other polymers, nylon and composite materials such as graphite sheets or grafil. Pallet system 400 may take any of a variety of forms suitable for use with a sporting implement and/or handle core. In an example, pallet system 400 may be shaped with eight bevels adjacent to each other. Eight elongate ridges are formed between the bevels along the length. In an example, pallet system 400 exhibits an octagonal cross-section.

While FIGS. 14-18 & 24-26 reflect a plane of split 490 of half shells 410 and 450 on the fourth and eighth bevels and being spaced from extension 460 by one bevel, half shells 410 and 450 may be split along any bevels with the split being spaced from extension 460 by more or fewer bevels. In a further example, split plane 490 may be between two edges of pallet 400. In another example, system 400 may be comprised of more than two shells.

FIGS. 1-26 illustrate non-limiting example manners of providing extensions to sporting equipment handles. The disclosure anticipates other manners of providing extensions to handles.

In another example, a transverse handle system includes a thin-walled annulus including a bottom and a top with a height therebetween. The annulus includes a central opening. A central axis directed through a center of the central opening extends in a direction of the height. A transverse extension projects from the thin-walled annulus curving from the bottom towards the top.

The thin-walled annulus is configured to partially encompass a handle pallet which surrounds a handle core, shaft or hairpin of the sporting implement. The thin-walled annulus may be further configured to encompass a sporting implement handle endcap which, together with a handle pallet, surrounds the handle core, shaft or hairpin.

The annulus may be formed from first and second mating shells which may be semi-annular. Through-holes in each of the first and second mating shells facilitate coupling the assembled first and second mating shells to form the annulus. Centers of the through-holes are aligned along an axis transverse to the central axis and are configured to receive a fastener for coupling the first and second mating shells around the handle pallet. In an example, the fastener is a crossbolt or cross-pin.

Additionally/alternatively, the annulus may include a concave interior surface configured to engage with a convex exterior surface of the handle pallet or an endcap. The annulus may be formed from a resilient, pliable material such that it can be slipped over the convex surface of the handle pallet or endcap where it will grip the same with the mating concave surface. In an example, the resilient annulus is formed from a rubber.

As with above-mentioned embodiments, the extension contacts an exterior lateral portion and upper portion of the fifth, fourth or third proximal phalanxes of the user's hand and constrains the hand in both the transverse and longitudinal aspects while allowing rotation of a first metacarpal of the hand away from the central axis. The extension may take any of a variety of dimensions and/or shapes suitable for constraining a hand of a sporting equipment user including but not limited to those described above.

In yet another example, a sporting implement shaft with an exterior surface extending between first and second ends around a central axis also includes a transversely-directed socket formed in the exterior surface. A transverse extension has a plug configured for receipt in the transversely-directed socket to secure the extension to the sporting implement shaft. One or more pallets and/or an endcap may be provided with an opening, channel or notch to accommodate the extension. With the one or more pallets secured around the shaft, the extension projects therethrough for contact with a user's hand. Similarly, with the endcap secured to the one or more pallets, the extension projects therethrough.

As with above-mentioned embodiments, the extension contacts an exterior lateral portion and upper portion of the fifth, fourth or third proximal phalanxes of the user's hand and constrains the hand in both the transverse and longitudinal aspects while allowing rotation of a first metacarpal of the hand away from the central axis. The extension may take any of a variety of dimensions and/or shapes suitable for constraining a hand of a sporting equipment user including but not limited to those described above.

In yet another example, the extension may be part of a sporting implement formed as one piece and additionally including one or more of a primary handle, a sporting implement shaft and a sporting implement blade.

FIG. 27 illustrates example sporting equipment 700 in use in association with an example extension 160 in accordance with embodiments of the disclosure. With a hand of a user gripping around the handle pallet, example extension 160 contacts an exterior lateral portion and upper portion of the fifth proximal phalanx of the hand. The hand is constrained in both the transverse and longitudinal aspects while being allowed rotation of a first metacarpal of the hand away from the central axis.

Figure 28:
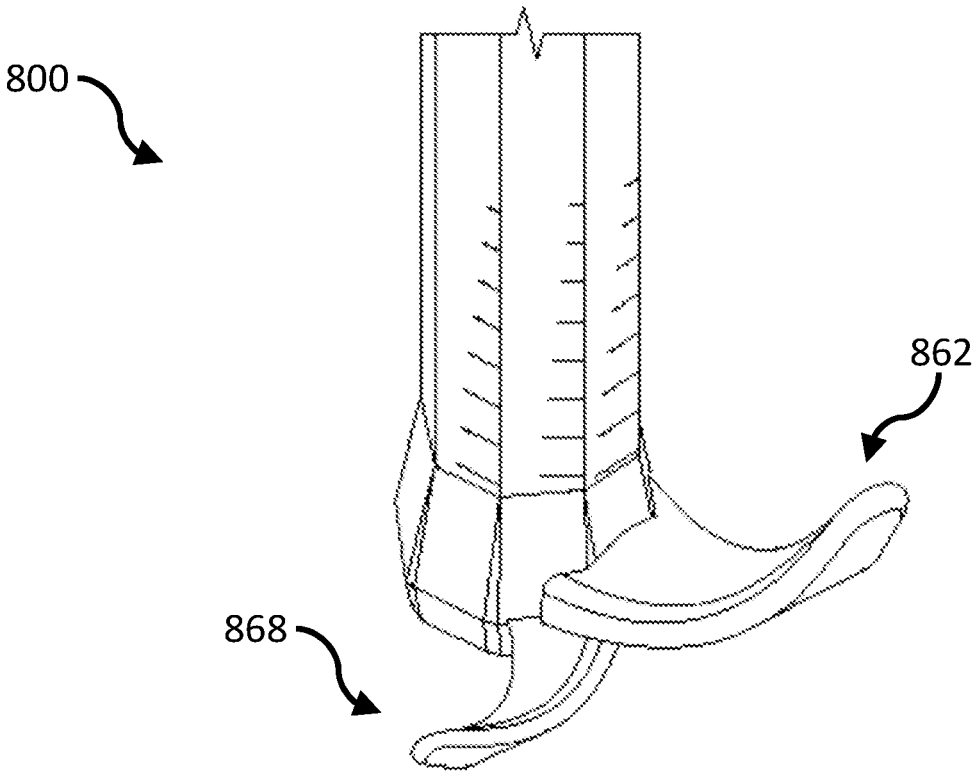
FIG. 28 illustrates an additional or alternative extension for sporting equipment.

FIG. 28 illustrates an additional or alternative transverse extension for a sporting implement 800. Extension 860 includes a branch yielding first 862 and second 868 extensions relatively rotated about the central axis and/or around a perimeter surrounding the bottom surface. Extension 860 may suitable for use in association with at least disclosed endcaps and pallets, for example, as an alternative to extension 160 or extension 460.

Embodiments of the disclosure are susceptible to being used for various purposes, including, though not limited to, enabling users to prevent their hands from sliding or twisting on a racket handle while reducing the amount of gripping force required. In addition to other sporting equipment, grip of rackets for tennis racquetball, squash badminton, pickleball and padel as well as table tennis paddles may be improved.

Modifications to embodiments of the disclosure described in the foregoing are possible without departing from the scope of the disclosure as defined by the accompanying claims. Expressions such as "including", "comprising", "incorporating", "consisting of", "have", "is" used to describe and claim disclosed features are intended to be construed in a non-exclusive manner, namely allowing for items, components or elements not explicitly described also to be present. Reference to the singular is also to be construed to relate to the plural.

What is claimed is:

1. An endcap for a sporting implement, comprising:
a rigid base portion including:
a bottom surface having a central axis normal thereto;
opposite the bottom surface, a receptacle configured to receive a portion of the sporting implement; and
surrounding the receptacle, at least one sidewall flaring towards the bottom surface; and
projecting from the base portion, a rigid transverse extension having a width at a longitudinal cross-section maximum height that is no greater than 75% of a width of the base portion.

2. The endcap as set forth in claim 1, wherein the extension curves towards the central axis.

3. The endcap as set forth in claim 1, wherein the extension includes, directed away from the rigid base portion bottom surface, a continuous upper surface which sweeps through an arc of less than 90 degrees away from the rigid base portion bottom surface.

4. The endcap as set forth in claim 1, wherein the extension further comprises a generally smooth inside surface facing generally towards the central axis.

5. The endcap as set forth in claim 1, wherein the extension has a concave surface facing towards the central axis.

6. The endcap as set forth in claim 1, wherein the base is comprised of first and second mating shells.

7. An endcap for a sporting implement, comprising:
a rigid base portion including:
a bottom surface having a central axis normal thereto;
opposite the bottom surface, a receptacle configured to receive a portion of the sporting implement; and
surrounding the receptacle, at least one sidewall flaring towards the bottom surface; and
projecting from the base portion, a rigid transverse extension including, directed away from the rigid base portion bottom surface, a continuous inside surface which sweeps through an arc of less than 90 degrees away from the rigid base portion bottom surface and including a width at a longitudinal cross-section maximum height that is no greater than 75% of a width of the base portion.

8. The endcap as set forth in claim 7, wherein the extension curves towards the central axis.

9. The endcap as set forth in claim 7, wherein the extension further comprises a generally smooth inside surface facing generally towards the central axis.

10. The endcap as set forth in claim 7, wherein the extension has a concave surface facing towards the central axis.

11. The endcap as set forth in claim 7, wherein the base is comprised of first and second mating shells.

12. A pallet system for a sporting implement, comprising:
a prism comprising first and second mating shells configured to house and grip a handle core of the sporting implement, the prism having:
configured to receive an endcap, a first end with a center;
distal from the first end, a second end having a center;
a central axis defined between the center of the first end and the center of the second end; and
an exterior surface defined between first and second ends, surrounding the central axis and flaring towards the first end; and
projecting from the exterior surface near the first end, a transverse extension having a width at a longitudinal cross-section maximum height that is no greater than 75% of a width of the prism.

13. The pallet system as set forth in claim 12, further comprising teeth provided to an interior surface opposite the exterior surface and configured to mesh with teeth provided to an exterior surface of the handle core of the sporting implement.

14. The pallet system as set forth in claim 12, wherein the extension curves towards the central axis.

15. The pallet system as set forth in claim 12, wherein the extension includes, directed towards the first and second mating shells, a continuous upper surface which sweeps through an arc of less than 90 degrees away from the first end.

16. The pallet system as set forth in claim 12, wherein the extension further comprises a generally smooth inside surface facing generally towards the central axis.

17. A pallet system for a sporting implement, comprising:
a prism comprising first and second mating shells configured to house and grip a handle core of the sporting implement, the prism having:
configured to receive an endcap, a first end with a center;
distal from the first end, a second end having a center;
a central axis defined between the center of the first end and the center of the second end;
an exterior surface defined between the first and second ends, surrounding the central axis and flaring towards the first end; and
projecting from the exterior surface near the first end, a transverse extension including, directed towards the second end, a continuous inside surface which sweeps through an arc of less than 90 degrees towards the second end and also including a width at a longitudinal cross-section maximum height that is no greater than 75% of a width of the prism.

18. The pallet system as set forth in claim 17, further comprising teeth provided to an interior surface opposite the exterior surface and configured to mesh with teeth provided to an exterior surface of the handle core of the sporting implement.

19. The pallet system as set forth in claim 17, wherein the extension curves towards the central axis.

20. The pallet system as set forth in claim 17, wherein the extension further comprises a generally smooth inside surface facing generally towards the central axis.

* * * * *